US008211601B2

(12) United States Patent
Yu et al.

(10) Patent No.: US 8,211,601 B2
(45) **Date of Patent: *Jul. 3, 2012**

(54) COATING FOR OPTICALLY SUITABLE AND CONDUCTIVE ANTI-CURL BACK COATING LAYER

(75) Inventors: Robert C. U. Yu, Webster, NY (US); Yuhua Tong, Webster, NY (US); Edward F. Grabowski, Webster, NY (US); Kock-Yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 582 days.

This patent is subject to a terminal disclaimer.

(21) Appl. No.: 12/430,037

(22) Filed: Apr. 24, 2009

(65) Prior Publication Data

US 2010/0273100 A1 Oct. 28, 2010

(51) Int. Cl.
*G03G 5/10* (2006.01)

(52) U.S. Cl. ..... 430/56; 430/60; 430/69

(58) Field of Classification Search ..... 430/56, 430/60, 69

See application file for complete search history.

(56) References Cited

U.S. PATENT DOCUMENTS

| | | | |
|---|---|---|---|
| 3,121,006 | A | 2/1964 | Middleton et al. |
| 4,286,033 | A | 8/1981 | Neyhart et al. |
| 4,291,110 | A | 9/1981 | Lee |
| 4,338,387 | A | 7/1982 | Hewitt |
| 4,464,450 | A | 8/1984 | Teuscher |
| 4,587,189 | A | 5/1986 | Hor et al. |
| 4,664,995 | A | 5/1987 | Horgan et al. |
| 4,921,773 | A | 5/1990 | Meinyk et al. |
| 5,069,993 | A | 12/1991 | Robinette et al. |
| 5,153,094 | A | 10/1992 | Kazmaier et al. |
| 5,166,339 | A | 11/1992 | Duff et al. |
| 5,189,155 | A | 2/1993 | Mayo et al. |
| 5,189,156 | A | 2/1993 | Mayo et al. |
| 5,215,839 | A | 6/1993 | Yu |
| 5,382,468 | A | 1/1995 | Chagnon et al. |
| 5,382,486 | A | 1/1995 | Yu et al. |
| 5,660,961 | A | 8/1997 | Yu |
| 5,756,245 | A | 5/1998 | Esteghamatian et al. |
| 5,919,590 | A | 7/1999 | Yu et al. |
| 5,958,638 | A | 9/1999 | Katayama et al. |
| 6,303,254 | B1 * | 10/2001 | Yu et al. ..... 430/56 |

(Continued)

FOREIGN PATENT DOCUMENTS

EP 1 884 833 A1 2/2008

OTHER PUBLICATIONS

European Search Report dated Mar. 24, 2011, EP Application No. 10160004.7, 6 pages.

Office Action from Canadian Intellectual Property Office dated Jul. 27, 2011 for Canadian Application No. 2,701,016, 3 pages.

*Primary Examiner* — Hoa V Le

(74) *Attorney, Agent, or Firm* — Pillsbury Winthrop Shaw Pittman LLP

(57) ABSTRACT

The presently disclosed embodiments relate generally to layers that are useful in imaging apparatus members and components, for use in electrostatographic, including digital, apparatuses. More particularly, the embodiments pertain to an improved electrostatographic imaging member incorporating a thermoplastic material pre-compounded to impart conductivity to the anti-curl back coating layer and may also contain an adhesion promoter which provides a conductively and optically anti-curl back coating layer. The conductive anti-curl back coating of the present disclosure may be formulated to have a single layer, dual layers, or triple layers.

10 Claims, 3 Drawing Sheets

U.S. PATENT DOCUMENTS

| | | | | |
|---|---|---|---|---|
| 7,166,399 | B2 | 1/2007 | Carmichael et al. | |
| 7,455,941 | B2 | 11/2008 | Evans et al. | |
| 7,462,434 | B2 | 12/2008 | Yu et al. | |
| 2004/0072088 | A1 | 4/2004 | Yu | |
| 2004/0086796 | A1 * | 5/2004 | Yu et al. | 430/58.15 |
| 2007/0054208 | A1 * | 3/2007 | Yu | 430/69 |
| 2007/0292797 | A1 | 12/2007 | Yu et al. | |
| 2009/0162637 | A1 * | 6/2009 | Grabowski et al. | 428/323 |

* cited by examiner

COATING FOR OPTICALLY SUITABLE AND CONDUCTIVE ANTI-CURL BACK COATING LAYER

BACKGROUND

The presently disclosed embodiments relate generally to layer(s) that are useful in imaging apparatus members and components, for use in electrostatographic, including digital, apparatuses. More particularly, the embodiments pertain to an improved flexible electrostatographic imaging member utilizing a thermoplastic material pre-compounded to impart conductivity to the formulation of an improved anti-curl back coating layer, and an adhesion promoter may also be included to produce a conductively and optically suitable anti-curl back coating layer of the present disclosure.

Flexible electrostatographic imaging members are well known in the art. Typical flexible electrostatographic imaging members include, for example: (1) electrophotographic imaging member belts (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper. The flexible electrostatographic imaging members may be seamless or seamed belts; a seamed belt is usually formed by cutting a rectangular imaging member sheet from a web stock, overlapping a pair of opposite ends, and welding the overlapped ends together to form a welded seam belt. Typical electrophotographic imaging member belts include a charge transport layer and a charge generating layer on one side of a supporting substrate layer and an anti-curl back coating coated onto the opposite side of the substrate layer. A typical electrographic imaging member belt does, however, have a more simple material structure; it includes a dielectric imaging layer on one side of a supporting substrate and an ant-curl back coating on the opposite side of the substrate. Although the scope of the present embodiments cover the preparation of all types of flexible electrostatographic imaging members, but for reason of simplicity, the discussion hereinafter will be focused on and represented only by flexible electrophotographic imaging members.

Flexible electrophotographic imaging members do include a photoconductive layer including a single layer or composite layers. Because typical electrophotographic imaging members exhibit undesirable upward imaging member curling, an anti-curl back coating (ACBC) is required to offset the curl. Thus, the application of the anti-curl back coating is necessary to render the imaging member with appropriate flatness.

Electrophotographic imaging members, e.g., photoreceptors, photoconductors, and the like, include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl back coating layer on the backside of the flexible substrate, opposite to the side of the electrically active layers, to render the desired photoreceptor flatness.

In current organic belt photoreceptors, an anti-curl back coating layer is used to balance residual stresses caused by the top coatings of the photoreceptor and eliminate curling. In addition, the anti-curl back coating layer should have optically suitable transmittance, for example, transparent, so that the photoreceptor can be erased from the back. Existing formulations for anti-curl back coating layers are of low conductivity such that the anti-curl back coating layer takes on a tribo-electrical charge during use in the image-forming apparatus. This tribo-electrical charge increases drag in the image-forming apparatus and increases the load on the motor and wear of the anti-curl back coating layer. The generation of tribo-electrical charge on the anti-curl back coating during electrophotographic imaging processes does at time build-up to the point that stalls the belt cycling altogether. Additional components to resolve or suppress the problem, such as inclusion of active countercharge devices, or additives, such as conductive agents, have been used to attempt to eliminate the tribo-charging of the layer. However, these options are not desirable as they have been found to create other sets of problems. Moreover, they do also increase costs and complexity by including additional components or include additives which produce anti-curl back coating (ACBC) dispersions that do not have the optically suitable clarity.

Thus, there is a need for an improved ACBC that does not suffer from the above-described problems and deficiencies.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

SUMMARY

According to aspects illustrated herein, there is provided a flexible imaging member comprising: a substrate, a charge generation layer, a charge transport layer, and an anti-curl back coating layer disposed on the substrate on a side opposite of the charge transport layer, wherein the anti-curl back coating layer comprises a thermoplastic material pre-compounded to impart conductivity to the anti-curl back coating layer and an adhesion promoter.

In another embodiment, there is provided a flexible imaging member comprising: a substrate, a charge generation layer, a charge transport layer, and a first anti-curl back coating layer disposed on the substrate on a side opposite of the charge transport layer and a second anti-curl back coating layer disposed on the first anti-curl back coating layer, wherein the second anti-curl back coating layer is a conductive layer.

In yet another embodiment, there is provided a flexible imaging member comprising: a substrate, a charge generation layer, a charge transport layer, and a first anti-curl back coating layer disposed on the substrate on a side opposite of the charge transport layer, a conductive second anti-curl back coating layer disposed on the first anti-curl back coating layer, and a conductive third anti-curl back coating disposed on the second anti-curl back coating.

BRIEF DESCRIPTION OF THE DRAWINGS

For a better understanding, reference may be made to the accompanying figure.

The FIG. 1 is a cross-sectional view of an electrophotographic imaging member in a flexible belt configuration according to the present embodiments;

Figure 2:
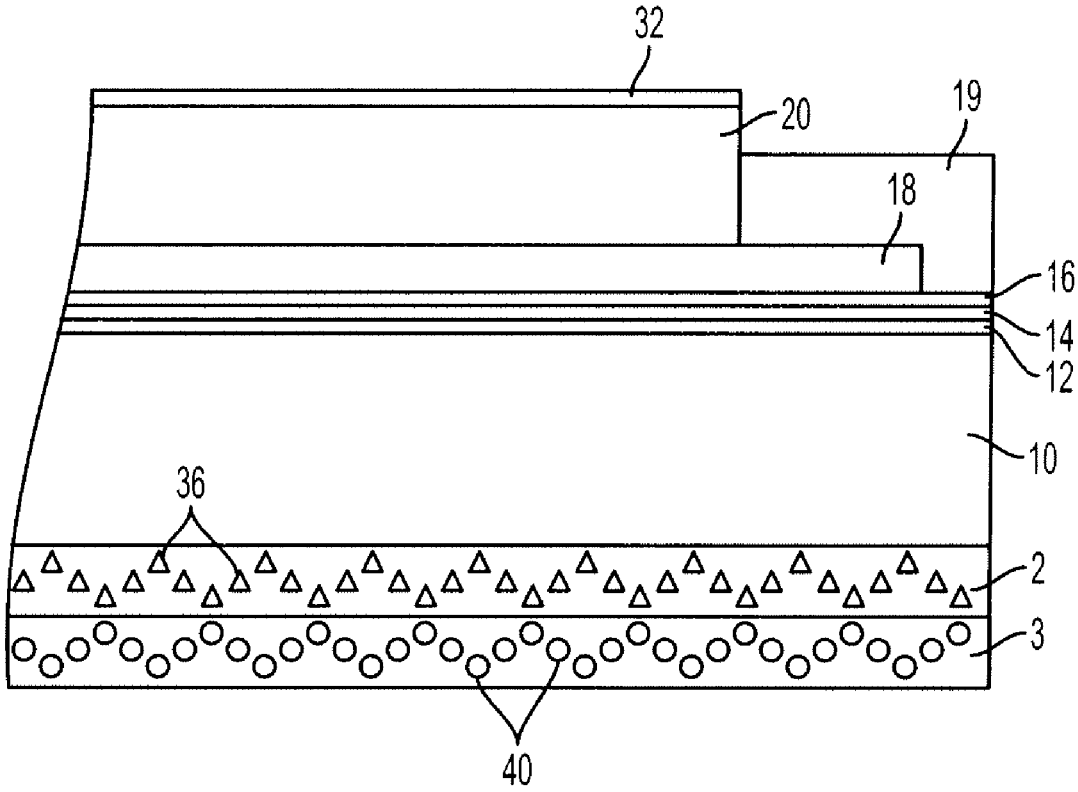
Figure 3:
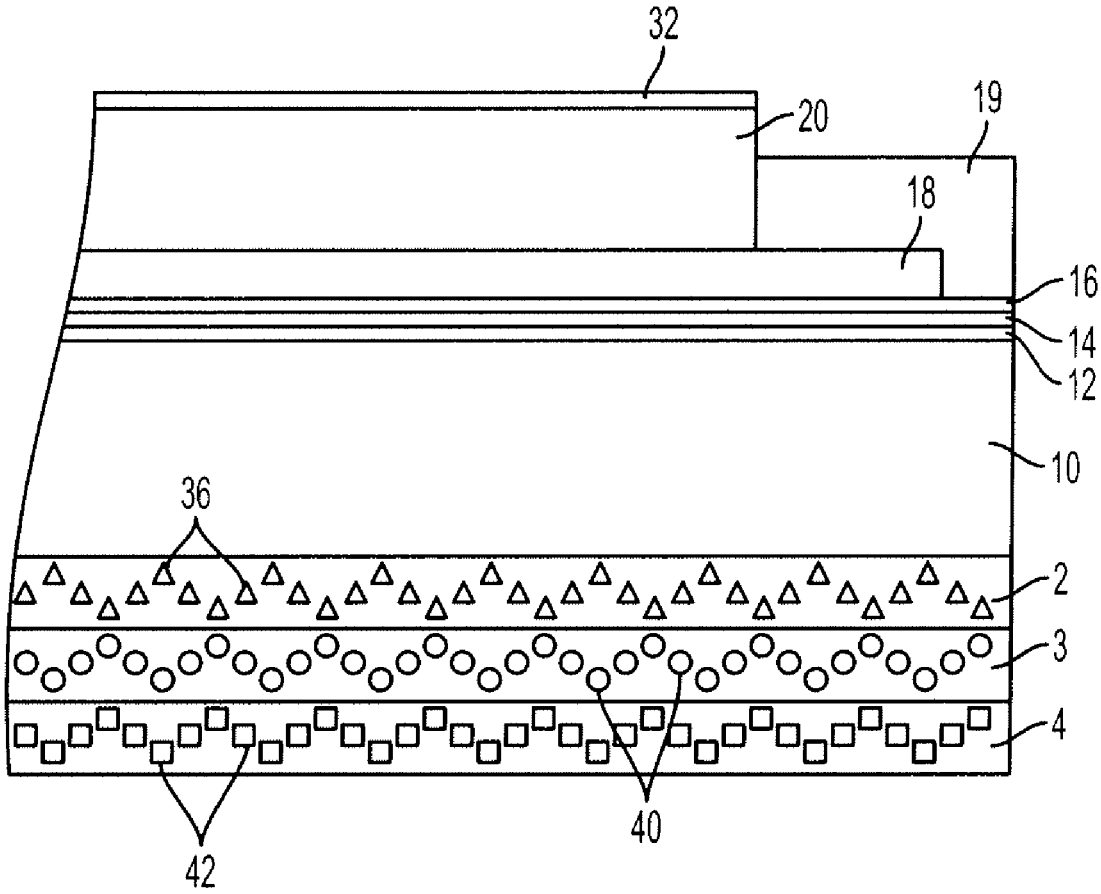

The FIG. 2 is a cross-sectional view of an electrophotographic imaging member in an alternative flexible belt configuration according to the present embodiments; and The FIG. 3 is a cross-sectional view of an electrophotographic imaging member in yet another alternative flexible belt configuration according to the present embodiments.

DETAILED DESCRIPTION

The presently disclosed embodiments are directed generally to an improved electrostatographic imaging member, particularly the flexible electrophotographic imaging member or photoreceptor, in which the anti-curl back coating layer is an optically suitable anti-curl back coating layer formed from a thermoplastic material pre-compounded to impart conductivity to the anti-curl back coating layer. In embodiments, the thermoplastic material comprises an anti-static copolymer comprising of polyester, polycarbonate, and polyethylene glycol units. The polyester may be selected from the group consisting of trans-1,4-cyclohexanedicarboxylic acid, trans-1,4-cyclohexanedimethanol, cis-1,4-cyclohexanedimethanol, and mixtures thereof.

Another embodiment provides an imaging member comprising a flexible imaging member comprising a substrate, a charge generation layer, a charge transport layer, and a first (or inner) anti-curl back coating layer disposed on the substrate on a side opposite of the charge transport layer and a second (or outer) anti-curl back coating layer disposed on the first anti-curl back coating layer, wherein the second anti-curl back coating layer comprises a thermoplastic copolymer pre-compounded to impart conductivity to the anti-curl back coating layer.

Yet another embodiment provides an imaging member comprising a flexible imaging member comprising a substrate, a charge generation layer, a charge transport layer, and a triple-layered anti-curl back coating which has a first (or inner) anti-curl back coating layer disposed on the substrate on a side opposite of the charge transport layer, a second (or intermediate) anti-curl back coating layer (comprising a thermoplastic material pre-compounded to impart conductivity) disposed on the inner anti-curl back coating layer, and a third (or outer) conductive anti-curl back coating (containing carbon nanotube dispersion in the layer) applied over the intermediate anti-curl back coating layer. The outer layer may be formulated to have either: (1) carbon nanotube dispersion in a polycarbonate material matrix or (2) carbon nano tube dispersion in the pre-compounded thermoplastic copolymer material matrix.

Still yet another embodiment provides an imaging member comprising a flexible imaging member comprising a substrate, a charge generation layer, a charge transport layer, and a triple-layered anti-curl back coating which has a first (or inner) anti-curl back coating layer disposed on the substrate on a side opposite of the charge transport layer, a second (or intermediate) conductive anti-curl back coating (containing carbon nanotube dispersion in the layer) applied over the inner anti-curl back coating layer anti-curl back coating layer, and a third (or outer) anti-curl back coating (comprising a thermoplastic material pre-compounded to impart conductivity) disposed on the intermediate anti-curl back coating layer. The intermediate layer may be formulated to have either: (1) carbon nanotube dispersion in a polycarbonate material matrix or (2) carbon nano tube dispersion in the pre-compounded thermoplastic copolymer material matrix.

In further embodiment, there is provided an image forming apparatus for forming images on a recording medium comprising a flexible imaging member having a charge retentive-surface for receiving an electrostatic latent image thereon, wherein the flexible imaging member comprises a substrate, a charge generation layer, a charge transport layer, and an anti-curl back coating layer disposed on the substrate on a side opposite of the charge transport layer, wherein the anti-curl back coating layer comprises a thermoplastic material pre-compounded to impart conductivity to the anti-curl back coating layer and an adhesion promoter, a development component for applying a developer material to the charge-retentive surface to develop the electrostatic latent image to form a developed image on the charge-retentive surface, a transfer component for transferring the developed image from the charge-retentive surface to a copy substrate, and a fusing component for fusing the developed image to the copy substrate.

An anti-curl back coating layer is used at the backside of the flexible support substrate to counteract and balance the upward curling effect caused by the tension pulling stress of the top coatings of the photoreceptor and render the desired photoreceptor belt flatness. The anti-curl back coating layer of this disclosure should have good adhesion to the substrate; and importantly, it should have optically suitable transmittance, for example, transparent, so that the photoreceptor can be erased from the back side of the belt during electrophotographic imaging processes. Existing formulations for anti-curl back coating layers are formulated from non conductivity polymer such that the anti-curl back coating layer takes on a tribo-electrical charge build-up arisen from its frictional interaction against belt support module components during use in the image-forming apparatus which increases drag in the image-forming apparatus and increases the load on the motor and wear of the anti-curl back coating layer. And at time, the tribo-electrical charge does build-up to such a degree that the photoreceptor belt cycling motion is stalled under a normal machine belt functioning condition. Additional machine components, such as active countercharge devices, have been used to eliminate or suppress the tribo-charging of the layer. However, the use of additional components adds to the costs and does also introduce complexity of the photoreceptor function so it is not desirable. Alternatively, anti-curl reformulation to include conductive agents such as carbon black dispersion in the anti-curl back coating layer to bleed off any tribo charges. Unfortunately, these dispersions are not very stable, lead to coating solution carbon black particles flocculation problems, and require milling the dispersion excessively, which in turn lowers the conductivity. Moreover, another problem arises too when using carbon black dispersion in the anti-curl back coating, it is required to use high dopant levels to achieve the conductivity needed for effective tribo-charging elimination. Nonetheless, high loading level addition not only has resulted in a layer that is almost always opaque not optically suitable for effective photoreceptor belt back erase, it has often been found to cause the creation of other adverse side effects as well. In the present disclosure, a thermoplastic material that is pre-compounded to impart conductivity to the anti-curl back coating layer is used so that both the electrical conductivity and optical transmission objectives of the formulated anti-curl back coating are met.

In electrostatographic reproducing or digital printing apparatuses using a flexible photoreceptor belt, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on the photoreceptor belt which has a charge-retentive surface. The developed toner image can then be transferred to a copy out-put substrate, such as paper, that receives the image via a transfer member.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be alternatively formulated and structured into a positively charged imaging member belt for use in positively charged systems.

Figure 1:
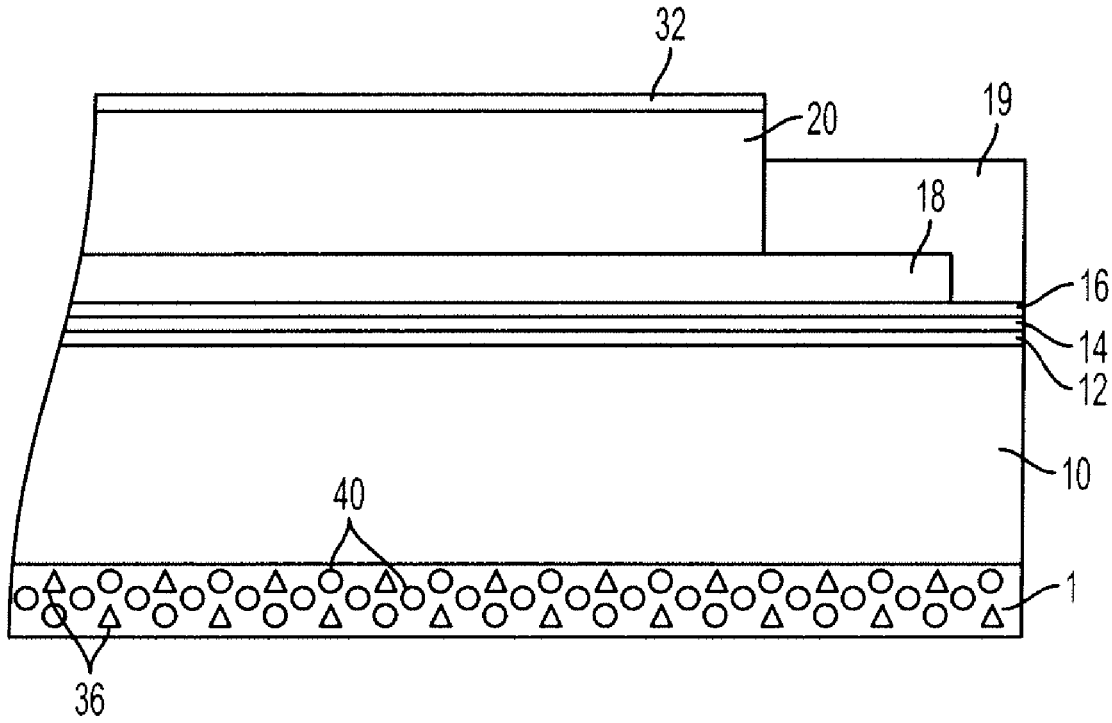

FIG. 1 is an exemplary embodiment of a flexible multilayered electrophotographic imaging member having a belt configuration according to the embodiments. In embodiments, the electrophotographic imaging member is a negatively charged electrophotographic imaging member. As can be seen, the belt configuration is provided with an anti-curl back coating 1, a flexible supporting substrate 10, an electrically conductive ground plane 12, an undercoat or hole blocking layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference. U.S. Pat. Nos. 7,462,434; 7,455,941; 7,166,399; and 5,382,486 further disclose exemplary photoreceptors and photoreceptor layers such as a conductive anti-curl back coating layer. The charge generation layer 18 and the charge transport layer 20 forms an imaging layer described here as two separate layers. In an alternative to what is shown in FIG. 1, the charge generation layer may also be disposed on top of the charge transport layer. It will be appreciated that the functional components of these layers may alternatively be combined into a single layer.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 1, the belt can be seamed or seamless. In other embodiments, the photoreceptor herein is rigid and is in a drum configuration.

The thickness of the substrate 10 of a flexible belt depends on numerous factors, including flexibility, mechanical performance, and economic considerations. The thickness of the flexible support substrate 10 of the present embodiments may be at least about 500 micrometers, or no more than about 3,000 micrometers, or be at least about 750 micrometers, or no more than about 2500 micrometers.

An exemplary flexible substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

In optional embodiments of the hole blocking may alternatively be prepared as an undercoat layer which may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The Adhesive Layer

An optional separate adhesive interface layer 16 may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group comprising of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

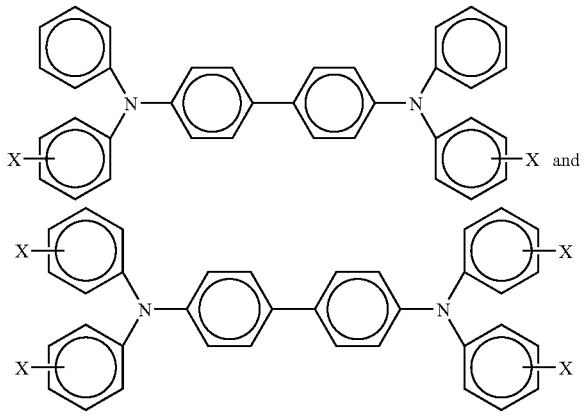

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

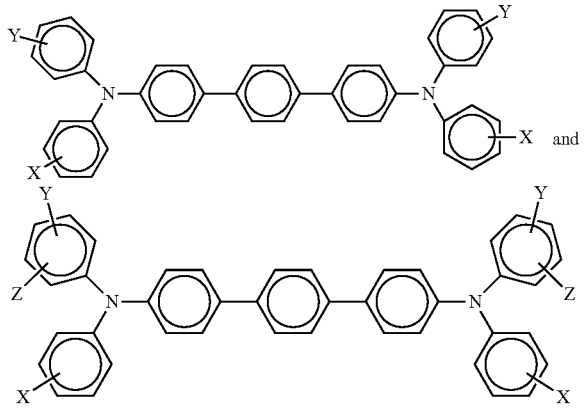

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-d i-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER®) TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

Any suitable and conventional technique may be utilized to form and thereafter apply the charge transport layer 20 mixture to the charge generating layer 18. The charge transport layer 20 may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

In addition, in the present embodiments using a belt configuration, the charge transport layer 20 may comprise of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Since the charge transport layer 20 is applied by solution coating process, the applied wet film is dried at elevated temperature and then subsequently cooled down to room ambient. The resulting photoreceptor web if, at this point, not restrained, will spontaneously curl upwardly into a 1½ inch tube due to greater dimensional contraction and shrinkage of the Charge transport layer than that of the substrate support layer 10.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. Therefore, typical overcoat layer is formed from a hard and wear resistance polymeric material. In embodiments, the overcoat layer 32 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 μm, or no more than 10 μm, and in further embodiments have a thickness of at least about 2 μm, or no more than 6 μm.

The Anti-Curl Back Coating Layer

Since the photoreceptor web exhibits spontaneous upward curling after completion of charge transport layer coating process, an anti-curl back coating is required to be applied to the back side of the substrate to counteract the curl and render flatness. The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 10, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 resin (Rohm and Haas), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 μm, or no more than about 35 μm, or about 14 μm.

The thermal coefficiency of the disclosed ACBC is important and should match that of the photo-active layers, in order to produce adequate counteracting result against the upward P/R curling effect and achieve the flatness of the photoreceptor devices. In the present embodiments, the ACBC is also optically transparent in the light wavelength of erasing light. Furthermore, the ACBC of the present embodiments has the desired static-electron dissipation capability that is preferred, and high wear resistance as well in order to have a long application life.

As previously discussed, anti-curl back coating (ACBC) layers incorporating a thermoplastic material pre-compounded to provide sufficient conductivity to give the anti-curl back coating layer adequate static charge dissipation capability which provides satisfactory electrical conductivity, optical transmission and adequate anti-curling capability. In particular, the present embodiments provide an anti-curl back coating formulation which demonstrates both dispersion stability and improved electrical conductivity by replacing the high molecular weight polycarbonate, that is often used in the conventional (typical) anti-curl back coating design, with a pre-compounded anti-static copolymer comprising of polyester, polycarbonate, and polyethylene glycol units in the molecular chain. The formed anti-curl back coating layer, in embodiments, exhibits good electrical conductivity and optical transparency as well.

FIG. 1 shows an imaging member having a belt configuration according to the embodiments. In the present embodiments, the anti-curl back coating 1 comprises a solid solution of an adhesion promoter 36 and a thermoplastic material 40. In particular embodiments, the thermoplastic material 40 comprises an anti-static copolymer having polyester, polycarbonate, and polyethylene glycol units in the molecular chain. In FIG. 1, the thermoplastic copolymer 40 and adhesion promoter 36 are illustrated and presented as separated entities, similar to that of particle dispersions in the material matrix of anti-curl back coating 1. However, this representation is solely for convenience in discussing the disclosure, and in reality, both the thermoplastic copolymer and the adhesion promoter do in fact form a homogeneous solid solution without phase separation. In embodiments, the adhesion promoter 36 is present in an amount of from about 1% to about 15%, or from about 5% to about 10%, by weight of the total weight of the resulting anti-curl back coating layer 1. In other embodiments, the thermoplastic material 40 is present in an amount of from about 85% to about 99%, or from about 90% to about 95% by weight of the anti-curl back coating layer 1. In yet further embodiments, the weight/weight ratio of the adhesion promoter 36 to the thermoplastic material or copolymer of polycarbonate 40 present in the anti-curl back coating layer is from about 1/99 to about 15/85. In addition, between about 0.5% and about 10% by weight polytetrafluoroethylene (PTFE) or silica dispersion, based on the total weight of the layer, may also be incorporated into the present embodiments to provide enhanced wear resistance to the anti-curl back coating layer of this disclosure.

The present embodiments provide a conductively and optically suitable anti-curl back coating layer having suitable optical transmission as well as electrical conductivity. For example, the embodiments provide an anti-curl back coating layer that exhibits an optical transparency of greater than 70 percent transmission based on total radiant energy transmitted through the coating layer. The present embodiments provide the desired higher transparency. The anti-curl back coating layer also exhibits, in embodiments, a surface resistivity of from about $1.0\times10^{4}$ to about $1.0\times10^{14}$ ohm/sq, or from about $1.0\times10^{6}$ to about $1.0\times10^{12}$ ohm/sq. The present embodiments exhibit excellent adhesion to the substrate, good anti-curling capability, and adequate optical clarity to allow photoreceptor belt back erase.

In alternative embodiments, shown in FIG. 2, the anti-curl back coating of this disclosure may comprise of dual layers—an inner layer 2 and an outer layer 3. For the dual layers of anti-curl back coating design, the inner (or bottom) layer is a standard/conventional polycarbonate anti-curl back coating applied directly onto the substrate support 10 while the outer (or top) thermoplastic (anti-static) copolymer layer is then solution coated over and fusion bonded to the inner layer without the need of adhesion promoter. The inner layer 2 may optionally comprise an adhesion promoter. However, the outer layer 3 comprises the anti-static thermoplastic copolymer 40 may also include an adhesion promoter. As stated above, for FIG. 1, the thermoplastic copolymer 40 and adhesion promoter 36 are illustrated and presented as separated entities, similar to that of particle dispersions in the material matrix of anti-curl back coating for ease of reference. In another alternative embodiments, the inner layer 2 comprises the anti-static thermoplastic copolymer 40 and an adhesion promoter while the outer layer 3 is formulated to comprise carbon nanotube (CNT) dispersion in the thermoplastic copolymer 40.

For dual layered anti-curl back coating design, the thickness of the inner layer may be thinner, thicker than, or equal to that of the anti-static outer layer. Nonetheless, the inner layer is preferred to be less than the outer layer.

For additional embodiments, shown in FIG. 3, the disclosed anti-curl back coating may be prepared to comprise of triple layers comprising of an inner layer 2, an intermediate layer 3, and an outer layer 4. In this triple-layered anti-curl back coating, the inner layer is a thin conventional polycarbonate layer, the intermediate layer is an anti-static thermoplastic copolymer 40 layer, and the outer layer 4 is a highly electrically conductive layer containing carbon nanotube (CNT) particles dispersion 42 in anti-static thermoplastic matrix. The inner layer may optionally comprise the adhesion promoter 36 while the intermediate layer and outer layer are capable of fusion bonding that requires no adhesion promoter addition. In another additional embodiments, the intermediate layer 3 comprises the anti-static thermoplastic copolymer 40 layer, and the outer layer 4 is a highly electrically conductive layer containing carbon nanotube (CNT) particles dispersion 42 in a polycarbonate matrix.

In extended embodiments of the disclosed triple-layered anti-curl back coating having a thin conventional polycarbonate inner layer 2, the intermediate layer 3 is a conductive carbon nanotube dispersed layer of anti-static thermoplastic copolymer 40, and the outer layer 4 comprises the anti-static thermoplastic copolymer 40.

In further extended embodiments of this disclosed triple-layered anti-curl back coating design having a thin conventional polycarbonate inner layer, the intermediate layer is formulated to comprise carbon nanotube dispersed in polycarbonate material matrix while the outer is the anti-static copolymer layer.

The total thickness of the triple-layered anti-curl back coating depends on the degree of photoreceptor upward curling after completion of charge transport layer, so it has to have a thickness adequately sufficient to counteract/balance the curl and provides flatness. The thickness of the inner layer would be about 40% of that of the thickness of intermediate and outer layers. Although the relative thickness between the intermediate layer and the outer layers may be in any suitable ratio, nonetheless it is preferred that both these layers have about equal in thickness.

In the present disclosure of the above embodiments containing conductive particle dispersed anti-curl back coating, dispersions of multi-wall carbon nanotubes, double-walled carbon nanotubes or single-walled carbon nanotube or a mixture thereof, can, however, be used at doping levels so that both the electrical conductivity and optical transmission objectives of the formulated anti-curl back coating are met. The dispersion level of carbon nanotube particles to activate suitable is layer conductivity is from about 0.01% to about 20%, and preferably between about 0.05% and about 10% by weight based on the total weight of the anti-curl back coating.

Carbon nanotubes, with their unique shapes and characteristics, are being considered for various applications. A carbon nanotube has a tubular shape of one-dimensional nature which can be grown through a nano metal particle catalyst. More specifically, carbon nanotubes can be synthesized by arc discharge or laser ablation of graphite. In addition, carbon nanotubes can be grown by a chemical vapor deposition (CVD) technique. With the CVD technique, there are also variations including plasma enhanced and so forth.

Carbon nanotubes can also be formed with a frame synthesis technique similar to that used to form fumed silica. In this technique, carbon atoms are first nucleated on the surface of the nano metal particles. Once supersaturation of carbon is reached, a tube of carbon will grow.

Regardless of the form of synthesis, and generally speaking, the diameter of the tube will be comparable to the size of the nanoparticle. Depending on the method of synthesis, reaction condition, the metal nanoparticles, temperature and many other parameters, the carbon nanotube can have just one wall, characterized as a single-walled carbon nanotube, it can have two walls, characterized as a double-walled carbon nanotube, or can be a multi-walled carbon nanotube. The purity, chirality, length, defect rate, etc. can vary. Very often, after the carbon nanotube synthesis, there can occur a mixture of tubes with a distribution of all of the above, some long, some short. Some of the carbon nanotubes will be metallic and some will be semiconducting. Single wall carbon nanotubes can be about 1 nm in diameter whereas multi-wall carbon nanotubes can measure several tens nm in diameter, and both are far thinner than their predecessors, which are called carbon fibers. It will be appreciated that differences between carbon nanotube and carbon nano fiber is decreasing with the rapid advances in the field. For purposes of the present embodiments, it will be appreciated that the carbon nanotube is hollow, consisting of a "wrapped" graphene sheet. In contrast, while the carbon nano fiber is small, and can even be made in dimension comparable to some large carbon nanotubes, it is a solid structure rather than hollow.

Carbon nanotubes in the present embodiments can include ones that are not exactly shaped like a tube, such as: a carbon nanohorn (a horn-shaped carbon nanotube whose diameter continuously increases from one end toward the other end) which is a variant of a single-wall carbon nanotube; a carbon nanocoil (a coil-shaped carbon nanotube forming a spiral when viewed in entirety); a carbon nanobead (a spherical bead made of amorphous carbon or the like with its center pierced by a tube); a cup-stacked nanotube; and a carbon nanotube with its outer periphery covered with a carbon nanohorn or amorphous carbon.

Furthermore, carbon nanotubes in the present embodiments can include ones that contain some substances inside, such as: a metal-containing nanotube which is a carbon nanotube containing metal or the like; and a peapod nanotube which is a carbon nanotube containing a fullerene or a metal-containing fullerene.

As described above, in the present embodiments, it is possible to employ carbon nanotubes of any form, including common carbon nanotubes, variants of the common carbon nanotubes, and carbon nanotubes with various modifications, without a problem in terms of reactivity. Therefore, the concept of "carbon nanotube" in the present embodiments encompasses all of the above.

One of the characteristics of carbon nanotubes resides in that the aspect ratio of length to diameter is very large since the length of carbon nanotubes is on the order of micrometers, and can vary from about 200 nm to as long as 2 mm. Depending upon the chirality, carbon nanotubes can be metallic and semiconducting.

Carbon nanotubes excel not only in electrical characteristics but also in mechanical characteristics. That is, the carbon nanotubes are distinctively tough, as attested by their Young's moduli exceeding 1 TPa, which belies their extreme lightness resulting from being formed solely of carbon atoms. In addition, the carbon nanotubes have high elasticity and resiliency resulting from their cage structure. Having such various and excellent characteristics, carbon nanotubes are very appealing as industrial materials.

Applied research that exploits the excellent characteristics of carbon nanotubes has been extensive. To give a few examples, a carbon nanotube is added as a resin reinforcer or as a conductive composite material while another research uses a carbon nanotube as a probe of a scanning probe microscope. Carbon nanotubes have also been used as minute electron sources, field emission electronic devices, and flat displays.

As described above, carbon nanotubes can find use in various applications. In particular, the applications of the carbon nanotubes to electronic materials and electronic devices have been attracting attention. In an electrophotographic imaging process, an electric field can be created by applying a bias voltage to the electrophotographic imaging components, comprising of resistive coating or layers. Further, the coatings and material layers are subjected to a bias voltage such that an electric field can be created in the coatings and material layers when the bias voltage is on and be sufficiently electrically relaxable when the bias voltage is off so that electrostatic charges are not accumulated after an electrophotographic imaging process. The fields created are used to manipulate unfused toner image along the toner path, for example from photoreceptor to an intermediate transfer belt and from the intermediate transfer belt to paper, before fusing to form the fixed images. These electrically resistive coatings and material layers are typically required to exhibit resistivity in a range of about $1\times10^{7}$ to about $1\times10^{12}$ ohm-cm and should possess mechanical and/or surface properties suitable for a particular application or use on a particular component.

It has been difficult to consistently achieve this desired range of resistivity with known coating materials. Two approaches have been used in the past, including ionic filler and particle filler; however, neither approach can consistently meet complex design requirements without some trade off. For example, coatings with ionic filler have better dielectric strength (high breakdown voltage), but the conductivity is very sensitive to humidity and/or temperature. In contrast, the conductivity of particle filler systems are usually less sensitive to environmental changes, but the breakdown voltage tends to below.

More recently, carbon nanotubes have been used in polyimide and other polymeric systems to produce composites with resistivity in a range suitable for electrophotographic imaging devices. Since carbon nanotube is conductive with very high aspect ratio, the desirable surface conductivity, about $10^{7}$ to about $10^{12}$ ohm/square (Ω/sq), can be achieved with very low filler loading. Thus, there is presented a significant advantage as the carbon nanotube will not change the property of the polymer binder at this loading level, and consequently, opens up design space for the selection of polymer binder for a given application.

Accordingly, dispersion of carbon nanotubes is viable approach to be adopted for flexible electrophotographic imaging member belt applications, particularly in the coatings and materials of certain components such as, for example, the photoreceptor anti curl back coating (ACBC). Thus, the present embodiments provide an alternative use of carbon nanotubes in a dispersion that has provided higher conductivity than those presently available materials disclosed in prior arts while also being able to maintain a much more stable coating solution and pot life. The resulting anti-curl back coating formed from such dispersion also have been shown to be optically suitable, for example, achieve relatively high transparency.

In further embodiments, 1% to 10% wt of silica or polytetrafluoroethylene (PTFE) dispersion may also respectively be included into the material matrix of the anti-static single layer, the outer layer of a dual-layer, or the outer layer of a triple-layer design to enhance the anti-curl back coating abrasion/wear resistance of the present disclosure.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Control Example

Anti-Curl Back Coating Preparation

A standard anti-curl back coating solution was prepared by dissolving proper amount of MAKROLON and PE200 adhesive promoter in methylene chloride to give a coating solution containing 10% wt solid. The resulting solution was then applied over a 3½ mil thick poly(ethylene naphthalate) (PEN) substrate using a 4½ mil gap bar by following the standard hand coating procedures. After drying the applied wet coating at 120° C. for 1 minute in the air circulating over, a 17 μm dried ACBC thickness was obtained. The resulting standard anti-curl back coating layer, comprising 92% wt Makrolon and 8% wt PE200, did exhibit upwardly curling to provide photoreceptor curl balancing effect. The standard anti-curl back coating layer that resulted was to be used as control.

Disclosure Example 1

Anti-Curl Back Coating Preparation

The disclosure anti-curl back coating solution was then prepared by following the same procedures described in the Control Example above, except that the polymer used was a thermoplastic material being a pre-compounded polymer having static-charge dissipation capability needed for total replacement of MAKROLON. The resulting disclosure anti-curl back coating (containing 8% wt PE200 adhesion promoter) thus prepared had a 17 μm in dried thickness and been seen to give equivalent upward curling like that of the standard control anti-curl back coating prepared in Control Example.

The adhesion promoter polyester PE-200 was purchased from Bostik, Inc. (Wauwatosa, Wis.). Anti-static copolymer STAT-LOY 63000 CTC, comprising of polyester, polycarbonate, and polyethylene glycol units in the molecular chain, was purchased from Saudi Basic Industries Corporation (SABIC) (Riyadh, Saudi Arabia); it was a glassy thermoplastic material. Nuclear magnetic resonance (NMR) analysis of this compounded polymer showed that it is a mixture of about 62 parts of polyester (formed by trans-1,4-cyclohexanedicarboxylic acid and trans/cis mixture of 1,4-cyclohexanedimethanol), 33 parts of Bisphenol A polycarbonate (PCA), and at least 6 parts of polyethylene glycol (PEG).

Disclosure Example 2

Dual-Layered Anti-Curl Back Coating Preparation

The disclosure anti-curl back coating was prepared to have a dual layers comprising of an inner layer and an outer layer. The inner layer, coated directly onto the PEN substrate, was a conventional layer prepared in the same procedures and material compositions according to the description of Control Example to give a 7 microns dried thickness. The outer layer was then solution applied over the inner layer in the same manner and material make-up as those described in Disclosure Example 1, except that PE-200 adhesion promoter was omitted; after drying at elevated temperature, the outer anti-static layer gave a 10 μm dried thickness and was fusion bonded to the inner layer. The resulting dual anti-curl back coating layers had a total thickness of about 17 μm and showed the same degree of upward curling as that seen in the anti-curl back coating of control Example.

Disclosure Example 3

Triple-Layered Anti-Curl Back Coating Preparation

In this conceptually constructed example, the anti-curl back coating of this disclosure may be prepared to comprise triple layers, comprising of an inner layer, an intermediate layer, and an outer layer. In this triple-layered anti-curl back coating design, it would have a thin conventional polycarbonate inner layer, an anti-static thermoplastic intermediate layer, and a highly electrically conductive outer layer containing carbon nanotube particles dispersion in anti-static thermoplastic matrix. In this triple layered anti-curl back coating design, addition of an adhesion promoter may optionally be omitted from both inner layer and outer layer formulations, because they will be fusion bonded to each other and to the inner polycarbonate layer as well by solution application. In embodiments, the carbon nanotube may be selected from the group consisting of single-walled carbon nanotube, double-walled carbon nanotube, multi-walled carbon nanotube, or mixtures thereof.

The total thickness of the triple-layered anti-curl back coating depends on the degree of photoreceptor upward curling after completion of charge transport layer, so it has to have a thickness adequately sufficient to counteract/balance the curl and provides flatness. The thickness of the inner layer would be about 40% of that of the thickness of intermediate and outer layers. Although the relative thickness between the intermediate layer and the outer layers may be in any suitable ratio, nonetheless it is preferred that both these layers have about equal in thickness.

The preparation of the inner layer and the intermediate layer were following the same procedures and using the same materials as those detailed in the above Disclosure Example 2.

However, the carbon nanotube dispersion-containing outer layer (with or optionally without adhesion promoter) is prepared by following either one of the two procedures detailed below:

Procedure I: Single-Walled Nanotubes Dispersed Outer Layer

A methylene chloride dispersion of a soluble single walled carbon nanotube dispersion with the high molecular weight polycarbonate was purchased from Zyvex. This dispersion had about 0.375% by weight of the single walled carbon nanotube and about 9.0% polycarbonate. Adhesion promoter polyester PE-200 was purchased from Bostik, Inc. (Wauwatosa, Wis.). Anti-static copolymer STAT-LOY 63000 CTC, comprising of polyester, polycarbonate, and polyethylene glycol units in the molecular chain, was purchased from Saudi Basic Industries Corporation (SABIC) (Riyadh, Saudi Arabia). Bisphenol A polycarbonate (PC) or 4,4'-isopropylidenediphenol (FPC-0170, lot #5BF2262) was purchased from Mitsuibishi Chemical Corporation (Tokyo, Japan).

Table 1 provides the formulations for the experimental anti-curl back coating layer dispersions using the single walled carbon nanotube, and where "g" represents grams.

TABLE 1

Formulation for Conductive ACBC

| Sample ID | 0.375% Single-walled Carbon Nanotube dispersion (g) | PE-200 (g) | Polycabonate (g) | Binder (g) | PTFE (g) | Methylene Chloride (g) |
|---|---|---|---|---|---|---|
| 1 | 3.0 | 0.13 | 1.49 | STAT-LOY: 0 | 0 | 16.40 |
| 2 | 19.5 | 1.23 | 0 | STAT-LOY: 7.48 | 1.23 | 82.65 |

The materials in each sample were mixed by a roll-mill for 18 hours. The resulted dispersions were coated on a MYLAR substrate by a 4.0-mil draw bar, and dried at 120° C. for 1 minute. After being dried, both samples above contained 0.625% single walled carbon nanotube.

Electrical Test

Surface resistivity measurements were performed on the prepared anti-curl back coating layers by a HIRESTA-UP MCP-HT450 high resistivity meter, available from Mitsubishi Chemical Corporation (Tokyo, Japan). Table 2 illustrates the results of the surface resistivity measurements (unit of the resistivity is: Ω/sq), and where "V" represents volts.

TABLE 2

| Surface Resistivity Measurement Results | | | | | |
|---|---|---|---|---|---|
| | Voltage | | | | |
| | 10 V | 100 V | 250 V | 500 V | 1000 V |
| Sample 1 | $1.0 \times 10^{12}$ | $1.0 \times 10^{13}$ | $1.0 \times 10^{13}$ | $1.0 \times 10^{14}$ | $1.0 \times 10^{14}$ |
| Sample 2 | $8.43 \times 10^{10}$ | $2.05 \times 10^{10}$ | $7.96 \times 10^{9}$ | $4.38 \times 10^{9}$ | $3.70 \times 10^{9}$ |

From these measurement results, with STAT-LOY copolymer as binder, the anti-curl back coating showed much lower surface resistivity, compared with polycarbonate alone as binder. This indicates that lower single walled carbon nanotube could be used in conductive ACBC to achieve good surface conductivity, which providing a window to fabricate ACBC with high transparency and high conductivity.

The coefficient of friction of the coated anti-curl back coating with aluminium was also measured. The results are listed in Table 3.

TABLE 3

| Coefficient of Friction for Conductive ACBC | | |
|---|---|---|
| Sample ID | Coefficient of Static Friction ($U_s$) | Coefficient of Kinetic Friction ($U_k$) |
| 1 | 4.568 | 4.441 |
| 2 | 5.185 | 3.844 |

With PTFE and STAT-LOY copolymer, the anti-curl back coating had lower kinetic coefficient of friction, which is highly desirable for a high performance anti-curl back coating layer.

Finally, optical transmission measurements were also taken. Optical transmission of the ACBC on poly(ethylene terephthalate) film was measured by a Perkin Elmer UV/Vis-NIR spectrometer, Lambda 19. There was no significant OD difference between these two samples, even though Sample (2) had PTFE and STAT-LOY copolymer. This result clearly demonstrates that the inventive anti-curl back coating can have high surface conductivity and high optical transparency.

Procedure II: Multi-Walled Nanotubes Dispersed Outer Layer

1% soluble multi walled carbon nanotube solution in methylene chloride was purchased from Zyvex. Adhesion promoter polyester PE-200 was purchased from Bostik, Inc. (Wauwatosa, Wis.). Anti-static copolymer STAT-LOY 63000 CTC, comprising of polyester, polycarbonate, and polyethylene glycol units in the molecular chain, was purchased from Saudi Basic Industries Corporation (SABIC) (Riyadh, Saudi Arabia). Bisphenol A polycarbonate (PC) or 4,4'-isopropylidenediphenol (FPC-0170) was purchased from Mitsuibishi Chemical Corporation (Tokyo, Japan).

Table 4 provides the formulations for the experimental anti-curl back coating layer dispersions using multi-walled carbon nanotube, and where "g" represents grams.

TABLE 4

| Formulation for Conductive ACBC | | | | |
|---|---|---|---|---|
| Sample ID | 1% Multi-walled Carbon Nanotube Dispersion (g) | PE-200 (g) | Binder (g) | Methylene Chloride (g) |
| 1 | 2.7 | 0.216 | STAT-LOY: 2.457 | 24.6 |
| 2 | 8.1 | 0.216 | STAT-LOY: 2.403 | 19.2 |
| 3 | 2.7 | 0.216 | PC: 2.457 | 24.6 |
| 4 | 8.1 | 0.216 | PC: 2.403 | 19.2 |

The materials in each sample were mixed by using a roll-mill for 18 hours. The resulting solutions were each hand coated on a MYLAR substrate by using a 4.5-mil gap bar, and subsequently dried at 120° C. for 1 minute. After being dried, Samples (1) and (3) contained 1% multi walled carbon nanotubes, and Samples (2) and (4) contained 3% multi walled carbon nanotubes.

After letting the coated samples sit still on the bench for one week, Samples (1) and (2) with STAT-LOY as binder for the carbon nanotube showed no observable precipitation, while Samples (3) and (4) had obvious phase separation. This is related to the dispersion stability of the carbon nanotube. Carbon nanotubes, having large cohesive energy density owing to their very large surface area as well as strong π-π interaction, tend to form bundles and cause low dispersibility in common organic solvents.

Electrical Test

Surface resistivity measurements were performed on the prepared anti-curl back coating layers by a HIRESTA-UP MCP-HT450 high resistivity meter, available from Mitsubishi Chemical Corporation (Tokyo, Japan). Table 5 illustrates the results of the surface resistivity measurements (unit of the resistivity is: Ω/sq), and where "V" represents volts.

TABLE 5

| Surface Resistivity Measurement Results | | | | | |
|---|---|---|---|---|---|
| | Voltage | | | | |
| | 10 V | 100 V | 250 V | 500 V | 1000 V |
| Sample 1 | $9.64 \times 10^{11}$ | $8.14 \times 10^{11}$ | $7.97 \times 10^{11}$ | $7.85 \times 10^{11}$ | $7.76 \times 10^{11}$ |
| Sample 2 | $>1.0 \times 10^{14}$ | $8.79 \times 10^{11}$ | $8.45 \times 10^{11}$ | $7.82 \times 10^{11}$ | $6.83 \times 10^{11}$ |
| Sample 3 | $>1.0 \times 10^{14}$ | $>1.0 \times 10^{14}$ | $>1.0 \times 10^{14}$ | $>1.0 \times 10^{14}$ | $>1.0 \times 10^{14}$ |
| Sample 4 | $>1.0 \times 10^{14}$ | $>1.0 \times 10^{14}$ | $>1.0 \times 10^{14}$ | $>1.0 \times 10^{14}$ | $>1.0 \times 10^{14}$ |

From the above measurement results, one can see that with STAT-LOY copolymer as binder, the re-formulated anti-curl back coating layer showed much lower surface resistivity as compared to that using polycarbonate as binder. There was no significant difference in surface resistivity for samples using the anti-static copolymer as binder or different carbon nanotube as filler in the experimental range. This result indicates that both single-walled and multi-walled carbon nanotubes can be used in the formulation of the present inventive conductive anti-curl back coating formulation to achieve good stability and surface conductivity which therefore provides a practical method for fabricating anti-curl back coating layers that have high transparency and high conductivity.

The outer nanotube dispersed layer prepared according to either procedures may optionally contain no adhesive promoter PE200, since the solution coated outer layer would fusion be fusion bonded to the intermediate anti-static thermoplastic layer.

Disclosure Example 4

Triple-Layered Anti-Curl Back Coating Preparation

In this example, the triple-layered anti-curl back coating of this disclosure would be prepared in the same manners and of identical material compositions as those detailed in Disclosure Example 3 above, but with the exception that the inner anti-static thermoplastic copolymer layer and the outer carbon nanotube dispersed layer would be exchanged in position.

Results

Comparison of the disclosure conductive anti-curl back coating layer prepared to give single layer and dual layers to that of the standard anti-curl back coating control prepared according to the three working examples given above demonstrate that the anti-curl back coating layer of Disclosure Examples 1 and 2 had equivalent anti-curling capability to provide photoreceptor counter-curling effect, adhesion bonding strength to the PEN substrate, and approximately the same optical transparency. More importantly, the disclosure anti-curl back coating of either formulation was found to give a surface resistivity of about $9\times10^{9}$ ohm/sq. which is lower than the electrically insulative standard control.

From the above measurement results, one can see that an anti-curl back coating formulation that incorporates the thermoplastic material disclosed herein provides an anti-curl back coating layer with much lower surface resistivity as compared to a standard anti-curl back coating layer without the thermoplastic material. There was no significant difference in anti-curling capability for samples using the thermoplastic material as binder in the experimental range as compared to the control sample. This result indicates that the a thermoplastic material, such as one comprising an anti-static copolymer, can be used in the formulation of the present inventive conductive anti-curl back coating formulation to achieve good anti-curling performance and surface conductivity which therefore provides a practical method for fabricating anti-curl back coating layers that have high transparency and high conductivity.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A flexible imaging member comprising:

a substrate;

a charge generation layer;

a charge transport layer; and an anti-curl back coating layer disposed on the substrate on a side opposite of the charge transport layer, wherein the anti-curl back coating layer comprises a thermoplastic material pre-compounded to impart conductivity to the anti-curl back coating layer and an adhesion promoter;

wherein the thermoplastic material comprises an anti-static copolymer and further wherein the copolymer comprises polyester, polycarbonate, and polyethylene glycol units in the molecular chain of the copolymer.

2. The imaging member of claim 1, wherein the anti-curl back coating layer has a surface resistivity of from about 1.0×104 to about 1.0×1014 ohm/sq.

3. The imaging member of claim 1, wherein the copolymer comprises a polyester/polycarbonate/polyethylene glycol ratio of about 62/33/6.

4. The imaging member of claim 1, wherein the polyester is selected from the group consisting of trans-1,4-cyclohexanedicarboxylic acid, trans-1,4-cyclohexanedimethanol, cis-1,4-cyclohexanedimethanol, and mixtures thereof.

5. The imaging member of claim 1, wherein the anticurl-back coating layer further comprises from about 1% to about 10% by weight polytetrafluoroethylene dispersion based on the total weight of the anticurl-back coating layer.

6. The imaging member of claim 1, wherein the anticurl-back coating layer further comprises from about 1% to about 10% by weight silica additives based on the total weight of the anticurl-back coating layer.

7. The imaging member of claim 1, wherein the thermoplastic material is present in an amount of from about 85% to about 99% and the adhesion promoter is present in an amount of from about 15% to about 1% by weight of the anti-curl back coating layer.

8. The imaging member of claim 7, wherein the thermoplastic material is present in an amount of from about 90% to about 95% and the adhesion promoter is present in an amount of from about 10% to about 5% by weight of the anti-curl back coating layer.

9. The imaging member of claim 1, wherein the anti-curl back coating layer is optically transparent.

10. The imaging member of claim 1, wherein the anti-curl back coating layer has a thickness of from about 3 micrometers to about 35 micrometers.

* * * * *